US007941060B2

(12) United States Patent
Enzien

(10) Patent No.: US 7,941,060 B2
(45) Date of Patent: May 10, 2011

(54) SYSTEMS AND METHODS FOR REMOTE DIAGNOSTICS OF DEVICES

(75) Inventor: Mark F. Enzien, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1130 days.

(21) Appl. No.: 11/537,315

(22) Filed: Sep. 29, 2006

(65) Prior Publication Data

US 2008/0080873 A1 Apr. 3, 2008

(51) Int. Cl.
*G03G 15/00* (2006.01)

(52) U.S. Cl. ..... 399/8

(58) Field of Classification Search ..... 399/8
See application file for complete search history.

(56) References Cited

U.S. PATENT DOCUMENTS

| | | | | |
|---|---|---|---|---|
| 5,241,402 | A | 8/1993 | Aboujaoude et al. | |
| 5,596,390 | A * | 1/1997 | Sawada | 399/8 |
| 5,781,871 | A | 7/1998 | Mezger et al. | |
| 6,766,232 | B1 | 7/2004 | Klausner | |
| 6,912,071 | B1 | 6/2005 | Rasmussen et al. | |
| 6,931,355 | B2 | 8/2005 | Farrell et al. | |
| 2005/0055248 | A1 | 3/2005 | Helitzer et al. | |

FOREIGN PATENT DOCUMENTS

| | | | |
|---|---|---|---|
| EP | 1 113 365 | A1 | 7/2001 |
| EP | 1 363 218 | A1 | 11/2003 |
| JP | 2005005839 | A * | 1/2005 |

OTHER PUBLICATIONS

European Search Report for Application No. EP 07 11 7142, dated Feb. 17, 2010.
Office Action issued Oct. 26, 2010 in European Patent Application No. 07117142.5.

* cited by examiner

*Primary Examiner* — David M Gray
*Assistant Examiner* — Erika Villaluna
(74) *Attorney, Agent, or Firm* — Oliff & Berridge, PLC

(57) ABSTRACT

A device management system for a plurality of devices, including a data collecting device that acquires device data for one or more of the plurality of devices, and a transmission circuit that transmits the device data to a device management, wherein the device management station determines any outlying devices within the plurality of devices. Moreover, a device management method for a plurality of devices that includes acquiring device data for one or more of the plurality of devices, transmitting the device data to a device management station, generating a control chart on the basis of the transmitted device data, determining whether at least one of the plurality of devices is outside at least on of the upper limit and the lower limit, and providing an appropriate action to take on the basis of the determination.

21 Claims, 3 Drawing Sheets

SYSTEMS AND METHODS FOR REMOTE DIAGNOSTICS OF DEVICES

BACKGROUND

The invention relates to the application of population statistics to the management of individual devices within a population of devices.

It is common for various types of devices to have local diagnostics embedded within them to assist in the servicing and repair of the devices. Generally, of these diagnostics require onsite support. Moreover, diagnostics may also be more tailored to individual modules within the devices. For example, a marking device exemplifies a modular device that may further include several modular, or swappable, components that enable an operator to reconfigure the device in order to meet requirements of a particular job. In many like devices, modularity permits customization or upgrading by adding and/or swapping one or more modules. To assist in maintenance, a multi-modular device often detects and stores information indicative of historical performance information of the respective modules onsite. Such data logs, or local data diagnostics, are generally examined locally to help technicians determine what, if any, corrective or maintenance action should be taken to maintain error-free operation of the device.

Some systems use telephone lines for transmitting data originating from such electronic system to a remote location. This remote location processes the information received from the electronic system for determining a failure diagnosis of a given electronic system. For example, some existing systems use networks for failure prediction where their diagnosis is based on querying data in the form of a network device management information base. Other systems perform remote diagnosis by collecting information from the managed device via a network in response to specific commands.

Alternatively, a plurality of electronic systems can be connected to a diagnostic server that receives data from the one or more electronic systems. This data can be as rudimentary as machine operational status to highly complex data that could, for example, indicate a particular component failure or be used for future failure prediction analyses, or for scheduling of routine maintenance. Also, the data could be as basic as a single component's on-off data, to system level measurement data, such data being collected in several different operational modes of the device, such as normal, failed, diagnostic, limp-along, or the like. This data allows for the determination of system faults and provides for the initialization of corrective or repair action.

SUMMARY

Various exemplary embodiments of the systems provide a device management system for a plurality of devices, including a data collecting device that acquires device data for one or more of the plurality of devices, and a transmission circuit that transmits the device data to a device management station for one or more of the plurality of devices, wherein the device management station determines any outlying devices within the plurality of devices.

Moreover, various exemplary embodiments of the methods provide a device management method for a plurality of devices that includes acquiring device data for one or more of the plurality of devices, transmitting the device data to a device management station, generating a control chart on the basis of the transmitted device data, the control chart determining an upper limit and a lower limit determining whether at least one of the plurality of devices is outside at least one of the upper limit and the lower limit, and providing an appropriate action to take on the basis of the determination.

Finally, various exemplary embodiments of the systems provide a device management system, including means for acquiring device data for each one of the plurality of devices, means for transmitting the device data to a device management station, means for generating a control chart on the basis of the transmitted device data, the control chart determining an upper limit and a lower limit, and means for determining whether at least one of the plurality of devices is outside at least one of the upper limit and the lower limit, means for outlining an appropriate action to be taken on the basis of the determination.

BRIEF DESCRIPTION OF THE DRAWINGS

Various exemplary embodiments of the systems and methods will be described in detail, with reference to the following figures, wherein.

DETAILED DESCRIPTION OF EMBODIMENTS

These and other features and advantages are described in, or are apparent from, the following detailed description of various exemplary embodiments of systems and methods.

Figure 1:
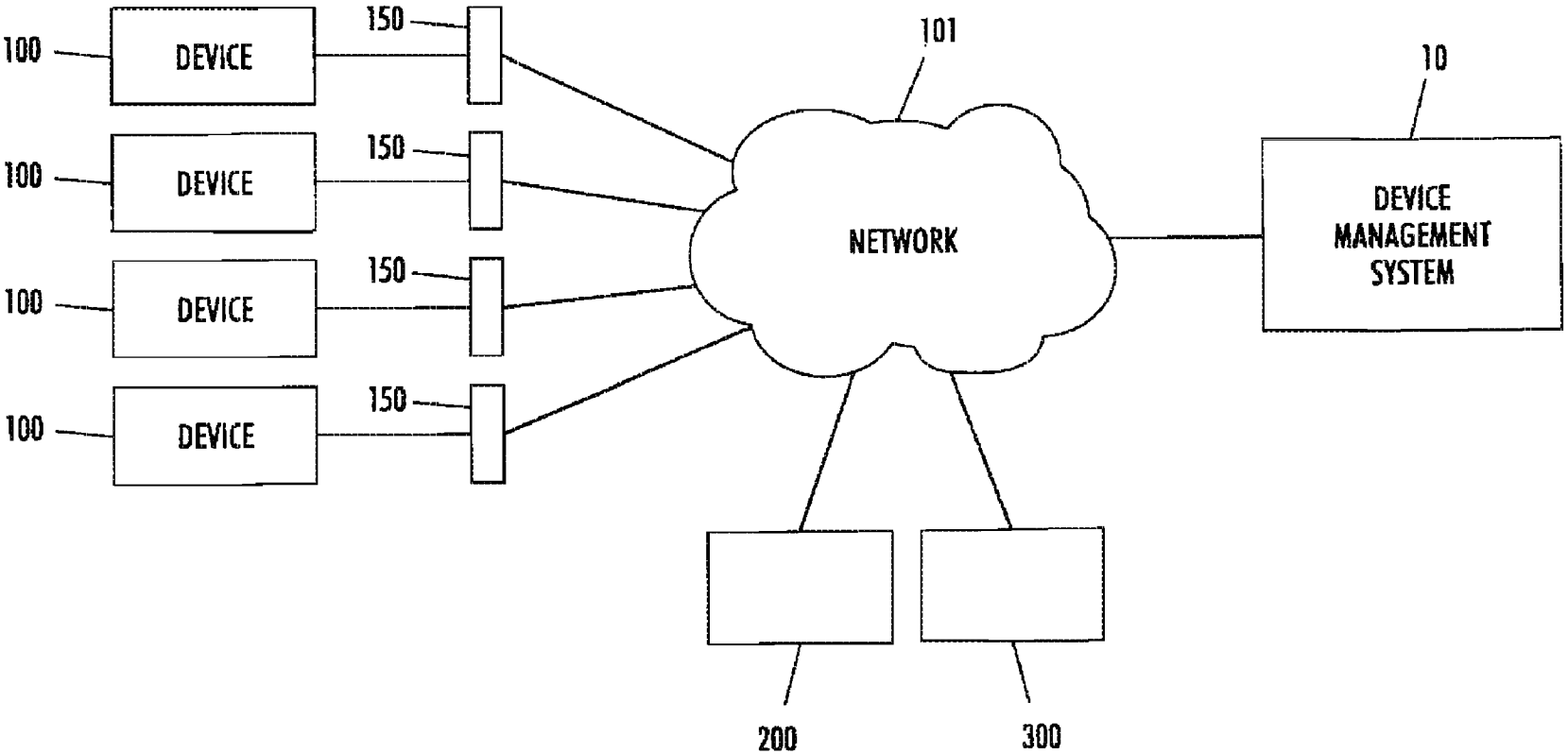
FIG. 1 is a functional block diagram illustrating an exemplary embodiment of a device management system.

FIG. 1 is a functional block diagram illustrating an exemplary embodiment of a device management system. As shown in FIG. 1, the device management system 10 may be functionally coupled to one or more third-party service providers 200, one or more parts or consumables suppliers 300, a remote device manager 400, and a plurality of devices 100 via a network 101. According to various exemplary embodiments, the plurality of devices 100 may be protected by firewalls 150. In operation, one or more of the plurality of devices 100 transmit information relative to their operation to the device management system 10 via the network 101. The information may also include consumption information from the parts or consumables suppliers 300 or form the third-party service providers 200. This information may then be processed and translated into statistical norms by the device management system 10. The statistical norms thus produced in the device management system 10 may then be downloaded to one or more of the plurality of devices 100. The downloaded information may contain information relative to most of or the entire population of devices 100, and can be used to derive population statistics to determine, for example, whether a given device 100 is running within the norm established by the population statistics.

Figure 2:
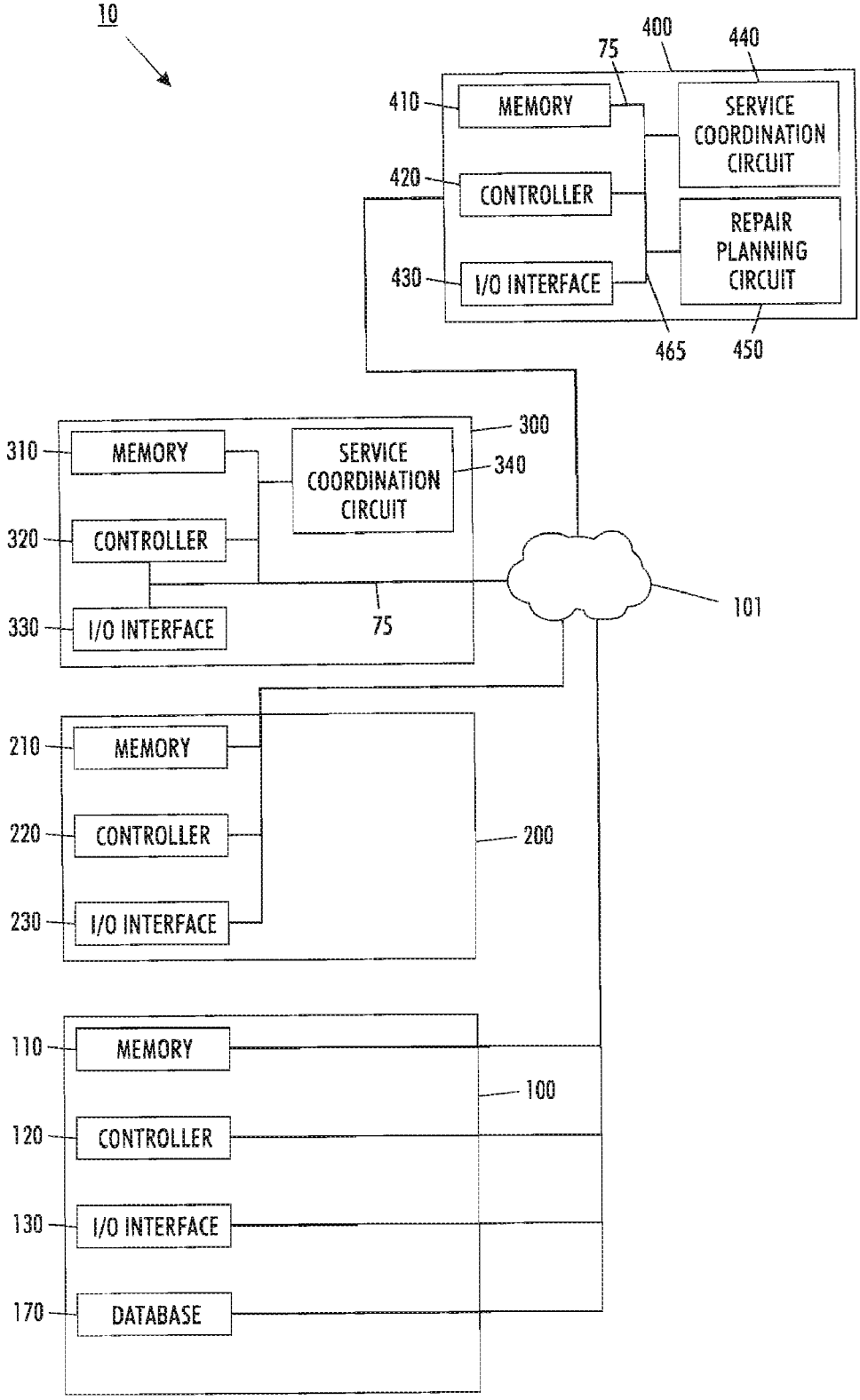
FIG. 2 is a functional block diagram illustrating an exemplary embodiment of a device management system.

FIG. 2 is a functional block diagram illustrating an exemplary embodiment of a device management system. As shown in FIG. 2, similarly to the illustration in FIG. 1, the device management system 10 includes a plurality of devices 100 to be managed (only one device 100 is illustrated for simplicity), one or more third-party service providers 200, one or more parts or consumables suppliers 300 and a remote device manager 400. The device 100 may be of an electro-mechanical device, an electronic device, a mechanical device, a combination thereof, or any other device that produces an output and that may consume a consumable.

According to various exemplary embodiments, the device 100, service providers 200, consumable suppliers 300 and device manager 400 are all connected via a network 101. The network 101 can be any one of, or combination of a direct serial connection, a distributed network such as an intranet a local area network, a metropolitan area network, a wide area network, a satellite communication network, an infrared communication network, the Internet, or the like. Furthermore, the links of the network can be a wired or wireless link or any other known or later developed elements that is capable of supplying electronic data to and from the connected elements.

According to various exemplary embodiments, the device manager 400 includes a memory 410, a controller 420, along with an I/O interface 430, a service coordination circuit 440, and a repair planning circuit 450, all interconnected.

According to various exemplary embodiments, the one or more devices 100 include a memory 110, a controller 120, an I/O interface 130, and a database 170, all interconnected. According to various exemplary embodiments, the one or more third party service providers 200 include a memory 210, a controller 220, and an I/O interface 230, all interconnected. According to various exemplary embodiments, the one or more parts/consumables suppliers 300 include a memory 310, a controller 320, an I/O interface 330 and a parts coordination circuit 340, all interconnected.

In operation, the one or more devices 100 generate device information such as, for example, control data, process data, and diagnostic data, during the course of operation of the device. Specifically, during the course of operation of the device, and in conjunction with the controller 120 and the memory 110. The device 100 may generate device operation information pertaining to the operational state of the device 100. For example, this status information may be on/off status of the device to highly specialized data that could, for example, pertain to itemization of one or more modules within the device. Moreover, the data may be a single module on-off data, or a system level measurement data. Specifically, the data may include, but is not limited to, control data such as commands issued by the device controller 120, scheduling and timing data, set-point and actuator data, sensor data and the like, diagnostic data such as fault counts, error counts, event counts, calibration data, device set-up data, high frequency service item information, service history data, machine history data and the like, environmental data such as temperature and humidity data, machine usage data, machine configuration data, value-added diagnostic data such as trend information, component signatures, qualitative state estimates, quantitative state estimates, and the like.

Additionally, the data could be generated as part of the normal operation of the device, or in response to specific interrogation and control commands issued by a user. For example, in the case of marking systems, the data could also include job level data such as number of pages in the job, the type of media used, the size of the job, the printing options, the finishing options, the number of pages actually printed, the number of images actually processed, and the like. Moreover, the data could be acquired in various operational modes of the device, including, but not limited to, normal, failed, limp-along, or the like.

According to various exemplary embodiments, for each one of the devices 100, device data may be forwarded, via the I/O interface 130, to the device manager 400 via the network 101. According to various exemplary embodiments, the device data may be forwarded to all, or a portion of, the service and/or parts suppliers 300, the third party service providers 200, or any other entity on the network.

The device manager 400, having received the device data from the one or more devices 100 via the I/O interface 430, stores the device data in a memory 440, with the cooperation of the controller 420.

In operation, the one or more devices 100 send information via their I/O interface 130 and the network to the device manager 400. According to various exemplary embodiments, under control of the controller 120, the database 170 holds information about the device 100 such as, for example, usage information, maintenance information and consumption information. Usage information may include, for example, the number of operation cycles since the device 100 was manufactured or purchased, the way in which the device 100 was operated such as intensive usage or light usage, the conditions under which the device 100 was operated, and the like. Maintenance information may include information about how frequently the device 100 underwent a check-up, was maintained and the quality level of the maintenance performed, and the like. Consumption information may include the type of consumable consumed by the device such as, for example, toner for a marking device, or gas for a vehicle. Consumption information may also include the amount of consumable consumed by the device 100, the quality of the consumable such as high grade or low grade, and the relationship between the consumable and the device output such as, for example, number of pages printed per pound of toner in a marking device, or number of miles driven per gallon of gas in the case of a vehicle.

According to various exemplary embodiments, this information is organized in the database 170 and stored in the memory 110, and may be sent to the device manager 400 via the network 101. When the device manager 400 receives similar information from a plurality of devices similar to the device 100 located at different sites that may be remote from the device manager 400, population statistics may be performed on the received data for one or more of the devices 100 by the device manager 400. Population statistics may be performed with the use of control chart theory, which helps determine, for example upper and lower limits of an acceptable operation of the device 100, and thus determines any outliers or "lemons" that may need to be replaced or repaired.

Control chart theory is generally implemented by using a type of chart that includes statistically determined upper and lower control limits as well as a center line based on a run chart. A run chart is basically a chart tracking various parameters during a given process or event. A control chart can be used to detect significant trends, cycles, and outlying points. The upper and lower limits of a given population are computed on, the basis of information received from the entire population, and in general may be located about three standard deviations from the centerline. The centerline may be calculated as the median value of the entire population. For example, the process in question may be a process of producing a given product which quality depends on the consumed amount of a specific ingredient. Like all processes, this process has variations associated with it, and many different factors may enter into a production process such as machines, suppliers, incoming raw materials, and workers, among other factors, can influence and produce variability in the end product. Ultimately, it is this variation in the end product that must be controlled if the manufacturer wishes to avoid lost production, poor quality, and eventually loss of customers. Hence, it is helpful to be able to statistically characterize a given population of such product, and determine possible problems in specific products on the basis of the behavior and characteristics of the specific products in relation to the remaining products of the entire population.

As discussed above, a control chart is a run chart that includes statistically generated upper and lower control limits. These limits provide a user with bounds on the common, cause or natural variability of the process output. Thus, common causes of variations can be separated from specific causes, and then the specific causes can be addressed, on an individual basis. Generally, all control charts have the same basic purpose, which is to provide evidence of whether a process has been operating in a state of statistical control and to signal the presence of special causes of variation so that corrective action can be take. Thus, empirical rule can be used to assist in developing and interpreting the control chart. Most control charts establish the upper and lower control limits at ±3 standard deviations σ from the centerline. For example, in the case of gas mileage of a vehicle, the empirical rule can state that approximately 99.73% of all gas mileage values for a vehicle should fall between 16.1 and 23.9 miles per gallon. Therefore, these limits can be used in a control chart to evaluate current and future performance of a specific vehicle. For example, if the vehicle at a certain point in time produces a gas mileage of 23 when the upper limit of the population is 23.9, chances are that no specific phenomenon or event has caused this gas mileage other than the expected common or natural causes. However, if a vehicle produces a gas mileage of 16 while the lower limit is 16.1, the vehicle is outside the control limits, or out-of-control, and thus outside the natural variability; which indicates that there is a very large chance that this value is the result of a specific cause affecting the operation of the vehicle, different than the common or natural causes.

If an out-of-control condition is detected such as, for example, the above-discussed gas mileage of 16 when the lower limit is 16.1, the next step may be to determine the cause of this out-of-control condition. When a cause or causes of the condition are identified, then appropriate action can be more easily achieved. For example, in the same example of a vehicle, if the cause of the out-of-control condition is a low pressure in the tires, then the pressure in the tires can be corrected. Additionally, the control may also track the performance of the tires during future operation cycles.

It should be noted that just because a given device performs between the control's upper and lower limits does not necessarily mean that the device is working properly. It may simply mean that the entire population is not working properly, which may indicate that, for example, the manufacturing process of the device as a whole is inadequate.

Figure 3:
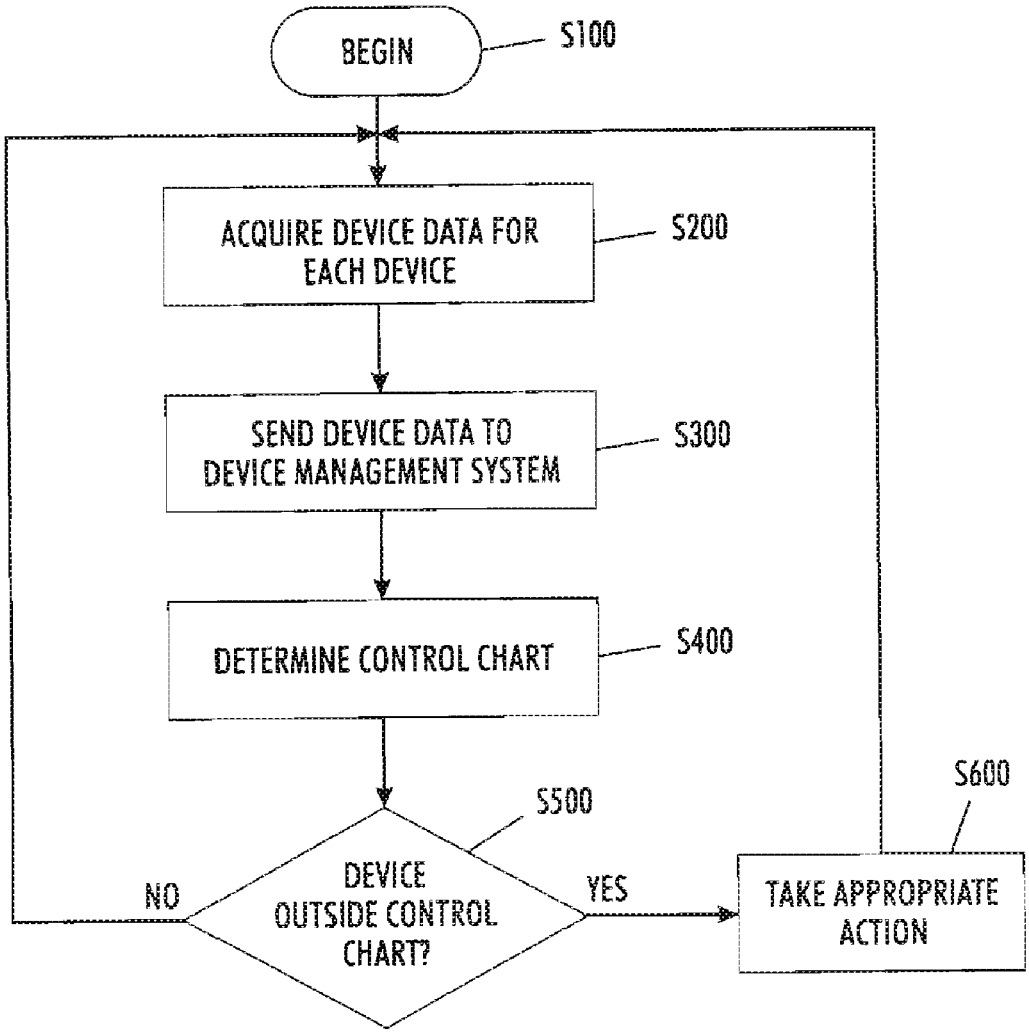
FIG. 3 is a flow chart illustrating an exemplary embodiment of a device management method.

FIG. 3 is a flow chart illustrating an exemplary embodiment of a device management method. As shown in FIG. 3, control begins in step S100 and continues to step S200, where device data is acquired in one or more devices that make up the population of devices. According to various exemplary embodiments, the device data for a specific device is collected in a database of the specific device and stored in a memory of the specific device. Device data may include usage data, maintenance data and/or consumption data. According to various exemplary embodiments, usage information may include, for example, the number of operation cycles since the device was manufactured or purchased, the way in which the device was operated such as intensive usage or light usage, and the conditions under which the device was operated. Maintenance information may include information about how frequently the device underwent a check-up and was maintained and the quality level of the maintenance performed on the device. Consumption information may include the type of consumable consumed by the device such as, for example, toner for a marking device, or gas or a vehicle. Consumption information may also include the amount of consumable consumed by the device, the quality of the consumable such as high grade or low grade, and the relationship between the consumable and the device output such as, for example, number of pages printed per pound of toner in a marking device, or number of miles driven per gallon of gas in the case of a vehicle. It should also be noted that device data may also include data relative to one or more modules included within the device. Next, control continues to step S300.

In step S300, the device data acquired for each device may be transmitted to a device management station. According to various exemplary embodiments, the device data is transmitted to the device management station via a network. According to various exemplary embodiments, the device data for each one of the devices is stored in a memory of the device management station. Next, control continues to step S400, where the data received from all the devices is computed, and a control chart is generated. According to various exemplary embodiments, the control chart highlights such parameters as the upper boundary, the lower boundary and the center line. According to various exemplary embodiments, the upper boundary may be determined as being equal to three times the standard deviation of the population, and the lower boundary may be determined as being equal to three times the standard deviation of the population. Next, control continues to step S500.

In step S500, a determination is made as to whether any of the pieces of data or parameters received from the entire population of devices are within the upper and lower limits determined by the control chart. According to various exemplary embodiments, if a parameter is outside the upper or lower boundary determined by the control chart, then control continues to step S600, otherwise control continues to step S200. Alternatively, if no device parameter is outside the upper and lower boundary determined by the control chart, the method may end. However, if one device parameter is outside the upper and lower boundaries determined by the control chart, then appropriate measures are taken in step S600 in order to correct this condition. For example, an appropriate measure may be to provide a user with a report of this outlying condition in order for the user to correct the condition. Alternatively, an appropriate measure may be to transmit that information back to the device in question so that an onsite user may correct the condition. An advantage of such a method is to enhance local and remote decision making to determine when can or need to be solved on a specific device. Thus, speed and accuracy in the repair or replacement of consumable parts can be achieved, and the ability to identify symptomatic problems is also greatly enhanced by also, for example, quickly identifying sub-performing devices. Next, control continues to step S200. Alternatively, after taking appropriate action in step S600, the method may end.

It will be appreciated that various of the above-disclosed and other features and functions, or alternatives thereof may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A device management system comprising:

a data collecting device that collects operational data from a plurality of monitored devices; and a statistical generating device that generates statistical norms of operation for a population of the plurality of monitored devices based on the collected operational data;

a selecting device that selects monitored devices having operational data that substantially varies from the generated statistical norms of operation; and an I/O interface that transmits the statistical norms back to all of the monitored devices that have the operational data that substantially varies from the generated statistical norms of operation, wherein the statistical norms comprise a control chart that identifies a lower boundary, an upper boundary and a center line, and the upper and lower boundaries are defined based on an analysis of the operational data from more than one of the monitored devices.

2. The system of claim 1, wherein the operational data comprises at least one of component level data, system level data, event level data, job level data, control data, environmental data, monitored device usage data, monitored device configuration data, monitored device malfunction data, or monitored device repair data.

3. The system of claim 1, wherein the operational data is acquired in one or more operational modes of the plurality of monitored devices, including at least one of a normal mode, a diagnostic mode, a failed mode or a limp-along mode.

4. The system of claim 1, wherein the operational data is data relative to one or more modules comprised within the device.

5. The system of claim 1, further comprising a repair planning device that determines an appropriate action based on the operational data;

wherein the appropriate action comprises at least one of an autonomous repair, a customer type repair, a customer service engineer type repair, and a report to a user.

6. The system of claim 1, wherein the data collecting device collects operational data over at least one of a LAN, a WAN or a wireless network.

7. The system of claim 1, wherein local diagnostics and population diagnostics are derived on the basis of the statistical norms.

8. The system of claim 1, wherein at least one of the lower boundary and the upper boundary is equal to three times a standard deviation of the plurality of monitored devices.

9. The system of claim 1, wherein the plurality of monitored devices comprise at least one of electro-mechanical devices, electronic devices, mechanical devices, or a combination thereof.

10. The system of claim 1, wherein the selecting device selects monitored devices that exhibit operational data located at more than three times a standard deviation from the center line.

11. The system of claim 1, wherein the selecting device selects monitored devices that exhibit operational data located outside at least one of the upper boundary or the lower boundary.

12. A device management method comprising:

collecting operational data from a plurality of monitored devices;

generating statistical norms for the plurality of monitored devices based on the collected operational data;

selecting monitored devices that have operational data that substantially varies from the generated statistical norms; and transmitting the statistical norms back to all of the monitored devices that have the operational data that substantially varies from the generated statistical norms via an I/O interface, wherein generating statistical norms comprises generating a control chart that identifies a lower boundary, an upper boundary and a center line for the plurality of monitored devices, and the upper and lower boundaries are defined based on an analysis of the operational data from more than one of the monitored devices.

13. The method of claim 12, wherein collecting operational data comprises collecting at least one of component level data, system level data, event level data, job level data, control data, environmental data, monitored device usage data, monitored device configuration data, or monitored device repair data.

14. The method of claim 12, wherein collecting operational data is performed in one or more modes of operation of the plurality of monitored devices, including at least one of a normal mode, a failed mode or a limp-along mode.

15. The method of claim 12, wherein collecting operational data comprises collecting data relative to one or more modules comprised in the monitored devices.

16. The method of claim 12, wherein selecting monitored devices comprises selecting monitored devices that exhibit operational data located at more than three times a standard deviation from the center line.

17. The method of claim 12, wherein selecting monitored devices comprises selected monitored devices that exhibit operational data located outside at least one of the upper boundary or the lower boundary.

18. The method of claim 12, further comprising taking appropriate action on at least one of the plurality of monitored devices.

19. The method of claim 18, wherein the appropriate action comprises at least one of an autonomous repair of the monitored devices, a customer type repair of the monitored devices, a customer service engineer type repair of the monitored devices, or a report to a user of the monitored devices.

20. An information storage medium embodied on a recordable medium, the storage medium comprising instructions to perform the device management method of claim 12.

21. A device management system, comprising:

means for collecting operational data from a plurality of monitored devices;

means for generating statistical norms for the plurality of monitored devices based on the collected operational data;

means for selecting monitored devices that have operational data that substantially varies from the generated statistical norms; and means for transmitting the statistical norms back to all of the monitored devices that have the operational data that substantially varies from the generated statistical norms, wherein generating statistical norms comprises generating a control chart that identifies a lower boundary, an upper boundary and a center line for the plurality of monitored devices, and the upper and lower boundaries are defined based on an analysis of the operational data from more than one of the monitored devices.

* * * * *